US006139122A

United States Patent [19]

Johnson

[11] Patent Number: 6,139,122

[45] Date of Patent: Oct. 31, 2000

[54] WARNING CONE DISPENSER APPARATUS

[75] Inventor: Mike Johnson, Bentonville, Ark.

[73] Assignee: Barbara Johnson, Bentonville, Ark.

[21] Appl. No.: 09/291,378

[22] Filed: Apr. 14, 1999

[51] Int. Cl.[7] ..... B65H 49/00

[52] U.S. Cl. ..... 312/34.1; 312/35

[58] Field of Search ..... 312/34.1, 34.8, 312/35, 42, 34.2, 34.3, 34.21, 34.23, 45, 72

[56] References Cited

U.S. PATENT DOCUMENTS

| | | | |
|---|---|---|---|
| 2,275,183 | 3/1942 | Josephs | 312/34.8 X |
| 2,887,983 | 5/1959 | Budd . | |
| 3,200,786 | 8/1965 | Swezy et al. . | |
| 3,291,096 | 12/1966 | Walter . | |
| 3,777,428 | 12/1973 | Caufield . | |
| 4,055,840 | 10/1977 | Uchytil et al. . | |
| 4,209,928 | 7/1980 | Kraayvanger . | |
| 4,256,050 | 3/1981 | Barnard . | |
| 4,817,318 | 4/1989 | Strauch . | |
| 4,848,263 | 7/1989 | Grimm . | |
| 4,991,538 | 2/1991 | Davids et al. | 312/34.8 X |
| 5,154,496 | 10/1992 | Campbell et al. | 312/34.8 |
| 5,199,375 | 4/1993 | Johnson . | |
| 5,763,984 | 6/1998 | Day | 312/34.8 |

FOREIGN PATENT DOCUMENTS

| | | | |
|---|---|---|---|
| 1188988 | 3/1965 | Germany . | |
| 404266716 | 9/1992 | Japan | 312/7.2 |
| 1395169 | 5/1975 | United Kingdom . | |

*Primary Examiner*—Peter M. Cuomo
*Assistant Examiner*—Hanh V. Tran
*Attorney, Agent, or Firm*—Aquilino, Welsh & Flaxman

[57] ABSTRACT

A dispensing apparatus which is used for conveniently storing and retrieving warning cones. The apparatus includes a housing having a storage chamber with at least one sleeve for storing a warning cone and a structure for mounting the housing to a support surface.

6 Claims, 3 Drawing Sheets

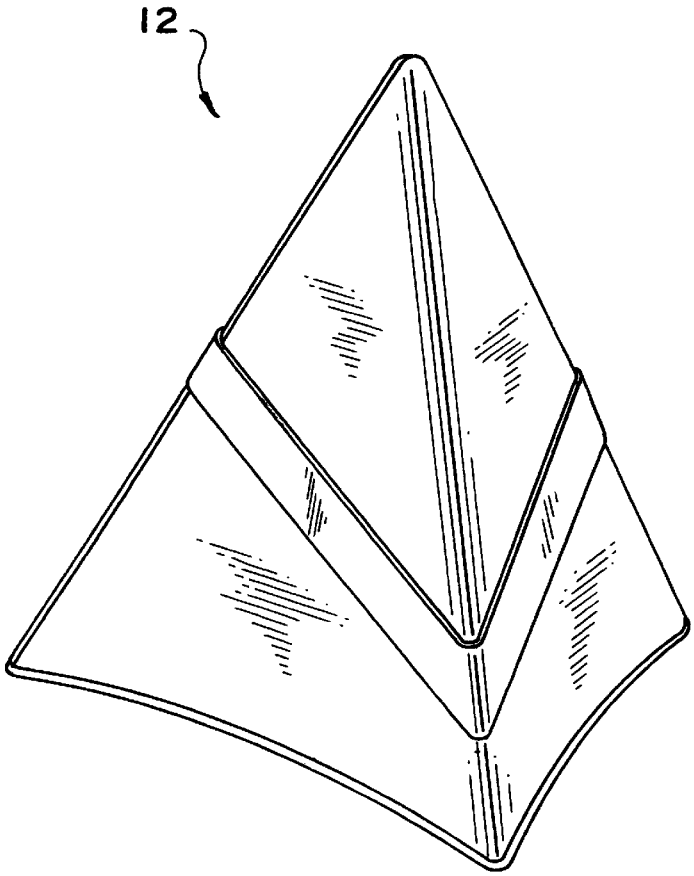
FIG. 3
FIG. 4
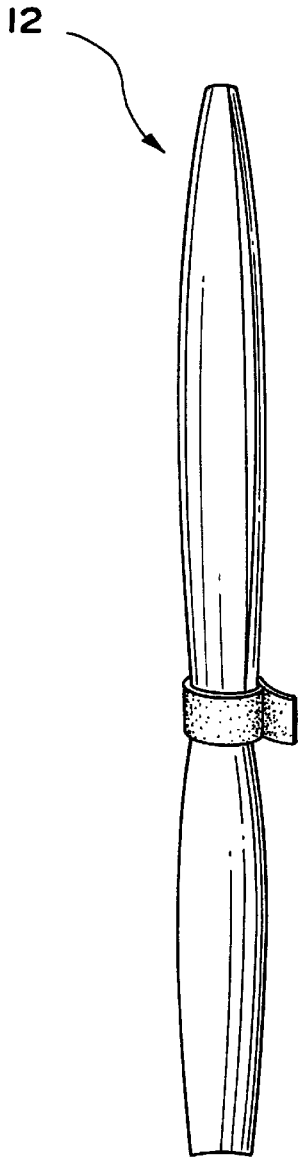

WARNING CONE DISPENSER APPARATUS

BACKGROUND OF THE INVENTION

1. Field of the Invention

The invention relates to a dispenser. More particularly, the invention relates to a dispenser for portable warning cones.

2. Description of the Prior Art

Readily available warning cones are necessary in a wide variety of environments. For example, grocery stores require warning cones to protect consumers when dangerous spills occur or when employees are loading and unloading shelves. Restaurants also require warning cones to protect diners from areas being cleaned and prepared for other purposes.

When warning cones are required in these environments, it is imperative that they be readily available. However, space is often at a premium in these business locations and finding a readily accessible location in which to store warning cones is often difficult.

In addition to the problems associated with finding space for storing the warning cones, it is important that the cones be stored in an aesthetically pleasing manner. The cones should also be stored in a manner permitting easy retrieval and return.

These considerations dictate the need for a dispensing apparatus from which warning cones may be readily stored and retrieved without appropriating valuable retail or work space. The present invention provides such a dispensing apparatus.

SUMMARY OF THE INVENTION

It is, therefore, an object of the present invention to provide a dispensing apparatus for conveniently storing and retrieving warning cones. The apparatus includes a housing having a storage chamber with at least one sleeve for storing a warning cone and means for mounting the housing to a support surface.

It is also an object of the present invention to provide a dispensing apparatus wherein the storage chamber includes a plurality of sleeves for storing warning cones.

It is a further object of the present invention to provide a dispensing apparatus wherein the housing includes a towel dispenser.

It is another object of the present invention to provide a dispensing apparatus wherein the housing further includes a storage cabinet for storing other materials which may be required by individuals.

It is also an object of the present invention to provide a dispensing apparatus wherein the storage compartment includes a door and a plurality of shelves.

It is a further object of the present invention to provide a dispensing apparatus wherein the door is curved.

It is another object of the present invention to provide a dispensing apparatus wherein the housing is a one piece construction.

Other objects and advantages of the present invention will become apparent from the following detailed description when viewed in conjunction with the accompanying drawings, which set forth certain embodiments of the invention.

BRIEF DESCRIPTION OF THE DRAWINGS

FIGS. 3 and 4 are views of the markers used in conjunction with the present dispensing apparatus.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
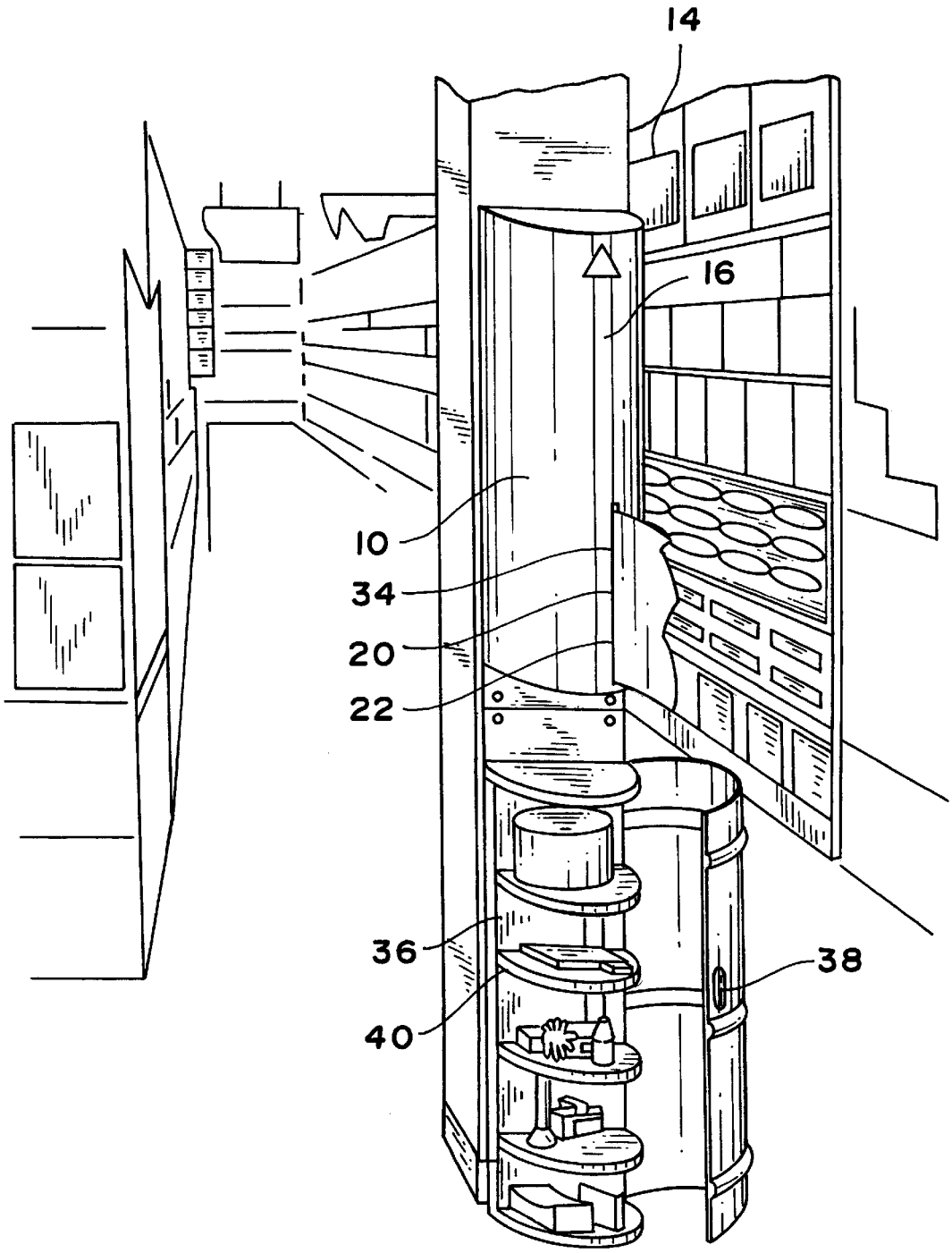
FIG. 1 is a perspective view of the present apparatus.
Figure 2:
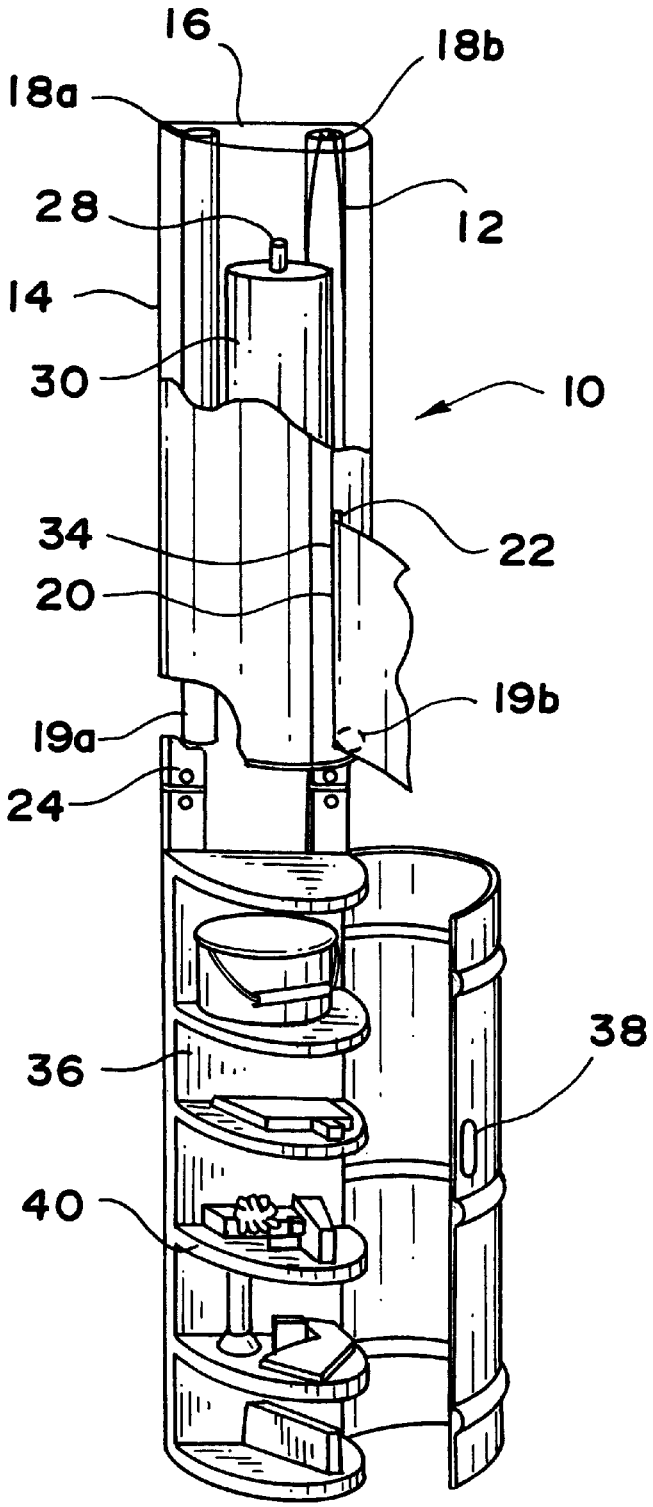
FIG. 2 is a partial exposed view of the present apparatus.

With reference to FIGS. 1 and 2, a warning cone dispensing apparatus 10 is disclosed. The apparatus 10 is designed for accessible storage and retrieval of portable warning cones 12. The dispensing apparatus 10 is also designed to hide the stored warning cones in an aesthetically pleasing manner, without appropriating expensive retail or business space.

The dispensing apparatus 10 is preferably designed to store and dispense the portable warning cones 12 embodied in the inventor's own U.S. Pat. No. 5,199,375, entitled "Folding Warning Marker", which is incorporated herein by reference. Briefly, the warning cones 12 used in accordance with the preferred embodiment of the present invention collapse into a substantially tubular shape (see FIG. 4) and expand to form a pyramidal warning cone (see FIG. 3). While the inventor's own warning cones are used in accordance with the preferred embodiment of the present invention, other warning cones may be employed without departing from the spirit of the present invention.

The dispensing apparatus 10 includes an upwardly extending housing 14. In accordance with a preferred embodiment of the present invention, the housing 14 is shaped and dimensioned for mounting adjacent a support column commonly found in grocery stores, and other retail stores. In this way, the dispensing apparatus 10 is very accessible, but takes up very little valuable space found within the confines of a grocery store, or other location.

While the dispensing apparatus 10 is disclosed above as being shaped and dimensioned for use in a grocery store, the shape of the dispensing apparatus 10 may be varied to suit application in a wide variety of locations. For example, the dispensing apparatus 10 could be varied for use in restaurants, department stores, or any other locations where ready access to warning cones is desired.

The housing 14 includes an upper storage chamber 16 in which the warning cones 12 are stored and retrieved. The storage chamber 16 includes two sleeves 18*a*, 18*b* in which warning cones 12 are placed. The sleeves 18*a*, 18*b* are integrally formed within the storage chamber 16. As such, the sleeves 18*a*, 18*b* are shaped and dimensioned for the storage of the warning cones 12. The resilience of the warning cones 12 helps to maintain them within the sleeves. In use, exposed openings 19*a*, 19*b* within the underside of the upper storage chamber 16 provide individuals with access to selectively withdraw the warning cones 12.

The storage chamber 16 may be further provided with a towel dispenser 20, allowing employees to readily retrieve towels used in the clean up of spills being marked by the warning cones 12. The towel dispenser 20 is incorporated along the front wall 22 of the storage chamber 16, and permits easy refills of the towels stored therein. The towel dispenser 20 is provided with a selectively opened door 24 allowing convenient access for refilling the towel dispenser

20. In addition, the towel dispenser 20 includes a rod 28 which is placed through the center of a roll of towels 30 for supporting the same within the towel dispenser 20. The rod 28 rests within a support slot (not shown) that holds it in place. In use, the towels protrude through a dispensing slot 34 in the front wall 22 such that the towel may be pulled and torn by an individual requiring a towel. The towel dispenser 20 is designed to use common inexpensive paper towels of a standard size. In many cases the replacement towels will be available on the shelves of the store where the dispensing apparatus is located.

The dispensing apparatus 10 is further provided with a selectively opened storage cabinet 36. Other materials required by employees handling problems which often occur within a store are stored within the storage cabinet 36. For example, spill cleaner, gloves, brushes, tissues, etc., may be stored within the storage cabinet 36.

The storage cabinet 36 includes a curved door 38 and a plurality of shelves 40. In accordance with the preferred embodiment of the present invention, the shelves 40 may be moveable and/or removable to permit adjustment of the space within the storage cabinet 36. The shelves 40 are further provided with cabinet shelf rails and corresponding hooks (not shown) commonly employed with cabinets and shelving units to accommodate the adjustment of shelve within the cabinet. While a semicircular storage cabinet design is disclosed in accordance with the preferred embodiment of the present invention, the storage cabinet 36 may take on a variety of designs to suit the needs of various applications. However, the semicircular design has been found to be the safest as it bests avoids contact with shoppers and shopping carts.

The dispensing apparatus 10 is preferably plastic molded and is mounted using self sticking tape, wooden screws, self tapping screws, power nails or banding. However, the dispensing apparatus 10 may be constructed from a variety of materials and may be mounted in any conventional manner without departing from the spirit of the present invention. In accordance with the preferred embodiment of the present invention, the dispensing apparatus 10 is made from a single piece of molded plastic (with the exception of the doors, shelves and other moveable parts), although other construction criteria may be used without departing from the spirit of the present invention. The dispensing apparatus 10 may be provided with "glow in the dark" materials to assist in locating the apparatus in darkness The present dispensing apparatus 10 is designed to provide convenience, speed and proper equipment for employees of a store. With this in mind, the storage cabinet 36 may be equipped with flashlights for emergency exits, personal protective equipment such as rubber gloves, protective eye wear and hazardous material containers (these are required by OSHA, and must be easily accessible). The personal protective equipment is used when there is exposure to blood born pathogens (blood, bodily fluids or other potentially infectious materials). The dispensing apparatus 10 would also be outfitted with a small broom and dust pan. The dispensing apparatus 10 may also be outfitted with battery operated emergency lights in case of a power outage and real or "dummy" surveillance cameras to discourage theft or monitor areas.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A dispensing apparatus comprising:

a housing including a towel dispenser, and a storage chamber having at least one sleeve with a warning cone selectively stored therein such that the waning cone may be selectively removed therefrom and used at a location remote from the dispensing apparatus; and means for mounting the housing to a support surface.

2. The dispensing apparatus according to claim 1, wherein the storage chamber includes a plurality of sleeves each with a warning cone selectively stored therein.

3. The dispensing apparatus according to claim 1, wherein the housing further includes a storage cabinet for storing other materials which may be required by individuals.

4. The dispensing apparatus according to claim 3, wherein the storage cabinet includes a door and a plurality of shelves.

5. The dispensing apparatus according to claim 4, wherein the door is curved.

6. The dispensing apparatus according to claim 1, wherein the housing is a one piece construction.

* * * * *